US010711945B2

(12) United States Patent
Posselt et al.

(10) Patent No.: US 10,711,945 B2
(45) Date of Patent: Jul. 14, 2020

(54) TRANSPORT CONTAINER

(71) Applicant: Linde Aktiengesellschaft, Munich (DE)

(72) Inventors: Heinz Posselt, Bad Aibling (DE); Marko Parkkonen, Ytterby (SE); Hans-Einar Forsberg, Vastra Frolunda (SE); Anders Gronlund, Hovas (SE)

(73) Assignee: Linde Aktiengesellschaft, Munich (DE)

( * ) Notice: Subject to any disclaimer, the term of this patent is extended or adjusted under 35 U.S.C. 154(b) by 0 days.

(21) Appl. No.: 16/098,497

(22) PCT Filed: May 4, 2017

(86) PCT No.: PCT/EP2017/025110
§ 371 (c)(1),
(2) Date: Nov. 2, 2018

(87) PCT Pub. No.: WO2017/190849
PCT Pub. Date: Nov. 9, 2017

(65) Prior Publication Data

US 2019/0145578 A1 May 16, 2019

(30) Foreign Application Priority Data

May 4, 2016 (EP) ..... 16000977

(51) Int. Cl.
*F17C 3/10* (2006.01)
*F17C 1/12* (2006.01)
*F17C 13/00* (2006.01)

(52) U.S. Cl.
CPC ..... *F17C 3/10* (2013.01); *F17C 1/12* (2013.01); *F17C 13/001* (2013.01);
(Continued)

(58) Field of Classification Search
CPC .. F17C 3/10; F17C 13/001; F17C 1/12; F17C 2270/01; F17C 2265/017; F17C 2260/033;
(Continued)

(56) References Cited

U.S. PATENT DOCUMENTS 2,871,669 A 2/1959 Mann et al.
3,698,200 A 10/1972 Johnson et al.
(Continued)

FOREIGN PATENT DOCUMENTS

JP 54-178218 U 12/1979
JP 2014-119058 A 6/2014

OTHER PUBLICATIONS

International Search Report dated Jul. 27, 2017 issued in corresponding PCT/EP2017/025110 application (3 pages).
(Continued)

*Primary Examiner* — Kareen K Thomas
(74) *Attorney, Agent, or Firm* — Millen White Zelano & Branigan, PC; Brion P Heaney

(57) ABSTRACT

The invention relates to a transport container (1) for helium (He), comprising an inner container (6) for receiving the helium (He), a coolant container (14) for receiving a cryogenic liquid ($N_2$), an outer container (2) in which the inner container (6) and the coolant container (14) are received, and a thermal shield (21) which can be actively cooled with the aid of the cryogenic liquid ($N_2$), the thermal shield (21) comprising a tubular base section (22) in which the inner container (6) is received, and a cover section (23, 24) that closes the base section (22) at the front and that is arranged between the inner container (6) and the coolant container (14), wherein an intermediate space (20) is provided between the inner container (6) and the coolant.

17 Claims, 7 Drawing Sheets

(52) U.S. Cl.
CPC ..... *F17C 2201/0109* (2013.01); *F17C 2201/0166* (2013.01); *F17C 2201/035* (2013.01); *F17C 2201/054* (2013.01); *F17C 2203/032* (2013.01); *F17C 2203/035* (2013.01); *F17C 2203/0308* (2013.01); *F17C 2203/0312* (2013.01); *F17C 2203/0316* (2013.01); *F17C 2203/0345* (2013.01); *F17C 2203/0366* (2013.01); *F17C 2203/0387* (2013.01); *F17C 2203/0391* (2013.01); *F17C 2203/0629* (2013.01); *F17C 2203/0643* (2013.01); *F17C 2205/0332* (2013.01); *F17C 2221/014* (2013.01); *F17C 2221/017* (2013.01); *F17C 2223/0161* (2013.01); *F17C 2223/033* (2013.01); *F17C 2227/0381* (2013.01); *F17C 2260/033* (2013.01); *F17C 2265/017* (2013.01); *F17C 2270/01* (2013.01)

(58) Field of Classification Search
CPC ..... F17C 2227/0381; F17C 2223/033; F17C 2223/0161; F17C 2221/017; F17C 2221/014; F17C 2205/0332; F17C 2203/0643; F17C 2203/0629; F17C 2203/0391; F17C 2203/0387; F17C 2203/0366; F17C 2203/035; F17C 2203/032; F17C 2203/0316; F17C 2201/054; F17C 2201/035; F17C 2201/0166; F17C 2201/0109; F17C 2203/0308; F17C 2203/0312; F17C 2203/0345
USPC ..... 220/560.04, 560.05, 560.06, 560.07, 220/560.08, 560.14
See application file for complete search history.

(56) References Cited

U.S. PATENT DOCUMENTS 3,762,175 A * 10/1973 Jones ..... F17C 3/02 62/45.1
3,768,765 A * 10/1973 Breckenridge, Jr. ..... F17C 13/086 248/146
3,782,128 A 1/1974 Hampton et al.
4,718,239 A * 1/1988 Nowobilski ..... F17O 3/10 62/50.4
5,005,362 A * 4/1991 Weltmer, Jr. ..... F17O 3/08 62/45.1
5,063,651 A * 11/1991 Kneip, Jr. ..... C23G 1/125 216/104
5,960,633 A * 10/1999 Limbach ..... F17C 1/12 62/45.1
7,568,352 B2 * 8/2009 Grayson ..... F17C 3/10 62/45.1
2005/0083198 A1 * 4/2005 Bulin ..... F17O 13/02 340/539.22
2007/0193282 A1 * 8/2007 Grayson ..... F17O 3/10 62/45.1
2008/0197137 A1 * 8/2008 Schlag ..... F17C 3/08 220/560.12
2010/0011782 A1 * 1/2010 Matthias ..... F17O 3/08 62/45.1
2010/0146992 A1 * 6/2010 Miller ..... F17O 3/04 62/47.1

OTHER PUBLICATIONS

Biblio. Abstract of JP 54-178218 U published Dec. 17, 1979.
Abstract of JP 2014-119058 A published Jun. 30, 2014.

* cited by examiner

TRANSPORT CONTAINER

Helium is extracted together with natural gas. For economic reasons, transport of large amounts of helium is expedient only in a liquid or supercritical form, that is to say at a temperature of approximately 4.2 to 6 K and under a pressure of 1 to 6 bar. For transporting the liquid or supercritical helium, use is made of transport containers which, to avoid the pressure of the helium increasing too rapidly, are provided with sophisticated thermal insulation. Such transport containers may be cooled for example with the aid of liquid nitrogen. This involves providing a thermal shield cooled with the liquid nitrogen. The thermal shield shields an inner container of the transport container. The liquid or cryogenic helium is accommodated in the inner container. The holding time for the liquid or cryogenic helium in the case of such transport containers is 35 to 40 days, that is to say after this time, the pressure in the inner container has increased to the maximum value of 6 bar. The supply of liquid nitrogen is sufficient for approximately 35 days. The thermal insulation of the transport container consists of high-vacuum multilayered insulation.

EP 1 673 745 B1 describes such a transport container for liquid helium. The transport container comprises an inner container in which the liquid helium is accommodated, a thermal shield which partially covers the inner container, a coolant container in which a cryogenic liquid for cooling the thermal shield is accommodated, and an outer container in which the inner container, the thermal shield and the coolant container are arranged.

Against this background, the object of the present invention is to provide an improved transport container.

Accordingly, a transport container for helium is proposed. The transport container comprises an inner container for receiving the helium, a coolant container for receiving a cryogenic liquid, an outer container in which the inner container and the coolant container are accommodated, and a thermal shield which is actively coolable with the aid of the cryogenic liquid, wherein the thermal shield has a tubular base portion in which the inner container is accommodated, and a cover portion which closes off the base portion at an end face and which is arranged between the inner container and the coolant container, and wherein an intermediate space, in which the cover portion of the thermal shield is arranged, is provided between the inner container and the coolant container.

The inner container may also be referred to as a helium container or inner tank. The transport container may also be referred to as a helium transport container. The helium may be referred to as liquid or cryogenic helium. The helium is in particular likewise a cryogenic liquid. The transport container is in particular set up to transport the helium in a cryogenic or liquid form or in a supercritical form. In thermodynamics, the critical point is a thermodynamic state of a substance that is characterized by the densities of the liquid phase and the gas phase becoming identical. At this point, the differences between the two states of aggregation cease to exist. In a phase diagram, the point is the upper end of the vapor pressure curve. The helium is introduced into the inner container in a liquid or cryogenic form. A liquid zone with liquid helium and a gas zone with gaseous helium then form in the inner container. Therefore, after being introduced into the inner container, the helium has two phases with different states of aggregation, namely liquid and gaseous. That is to say, there is a phase boundary between the liquid helium and the gaseous helium in the inner container. After a certain time, that is to say when the pressure in the inner container increases, the helium situated in the inner container becomes single-phase. The phase boundary then no longer exists and the helium is supercritical.

The cryogenic liquid or the cryogen is preferably liquid nitrogen. The cryogenic liquid may also be referred to as coolant. The cryogenic liquid may alternatively also be for example liquid hydrogen or liquid oxygen. The statement that the thermal shield is actively coolable or actively cooled is to be understood as meaning that the thermal shield is at least partially flowed through or flowed around by the cryogenic liquid in order to cool it. In particular, the thermal shield is actively cooled only in an operating state, that is to say when the inner container is filled with helium. When the cryogenic liquid has been used up, the thermal shield may also be uncooled. During the active cooling of the thermal shield, the cryogenic liquid can boil and evaporate. As a result, the thermal shield is at a temperature which corresponds approximately or exactly to the boiling point of the cryogenic liquid. The boiling point of the cryogenic liquid is preferably higher than the boiling point of the liquid helium. The thermal shield is in particular arranged inside the outer container.

Preferably, the inner container, and in particular the insulating element, is, on the outside, at a temperature which corresponds approximately or exactly to the temperature of the helium stored in the inner container. The temperature of the helium is 4.2 to 6 K according to whether the helium is in a liquid or supercritical form. Preferably, the cover portion of the thermal shield completely closes off the base portion at an end face. The base portion of the thermal shield may have a circular or approximately circular cross section. The outer container, the inner container, the coolant container and the thermal shield may be constructed rotationally symmetrically in relation to a common axis of symmetry or center axis. The inner container and the outer container are preferably produced from high-grade steel. The inner container preferably has a tubular base portion, which is closed on both sides by curved cover portions. The inner container is fluid-tight. The outer container preferably likewise has a tubular base portion, which is closed at each of the two end faces by cover portions. The base portion of the inner container and/or the base portion of the outer container may have a circular or approximately circular cross section.

The fact that the thermal shield is provided ensures that the inner container is surrounded only by surfaces which are at a temperature corresponding to the boiling point of the cryogenic liquid (boiling point of nitrogen at 1.3 bara: 79.5 K). As a result, there is only a small difference in temperature between the thermal shield (79.5 K) and the inner container (temperature of the helium at 1 bara to 6 bara: 4.2 K to 6 K) in comparison with the surroundings of the outer container. This allows the holding time for the liquid helium to be lengthened significantly in comparison with known transport containers. In this case, heat is transferred from the surfaces of the inner container to the thermal shield only by radiation and residual gas conduction. That is to say, the surface of the thermal shield makes no contact with the inner container. The fact that the cover portion of the thermal shield is arranged between the inner container and the coolant container means that, even when there is a falling liquid level of the cryogenic liquid in the coolant container, it is at all times ensured that the inner container is surrounded by surfaces which are at the boiling temperature of the liquid nitrogen even in the direction of the coolant container. The transport container has in particular a holding time for helium of at least 45 days, and the supply of the cryogenic liquid is sufficient for at least 40 days.

According to one embodiment, the thermal shield is arranged in an evacuated intermediate space provided between the inner container and the outer container.

The fact that the intermediate space is evacuated means that the thermal insulation of the inner container can be improved. Preferably, the inner container comprises an additional insulating element having a multilayered insulating layer and a metallically bright copper layer which faces the shield. The insulating layer preferably comprises multiple alternately arranged layers of perforated and embossed aluminum foil, as a reflector, and glass paper, as a spacer, between the aluminum foils. The insulating layer may comprise 10 layers. The layers of aluminum foil and glass paper are applied on the inner container without any gaps, that is to say are pressed. The insulating layer is a so-called MLI (multilayer insulation) or may be referred to as an MLI. The insulating element is preferably likewise at a temperature which corresponds at least approximately or exactly to the boiling point of helium. A further multilayered insulating layer, in particular likewise an MLI, may be arranged between the thermal shield and the outer container, which insulating layer fills the intermediate space between the thermal shield and the outer container and thus makes contact with the outside of the thermal shield and the inside of the outer container. In contrast to the above-described insulating element of the inner container, in this case, layers of aluminum foil and glass paper, glass silk or glass mesh fabric of the insulating layer are preferably introduced loosely into the intermediate space. "Loosely" means here that the layers of aluminum foil and of glass paper, glass silk or glass mesh fabric are not pressed, with the result that the embossing and perforation of the aluminum foil allows the insulating layer, and consequently the intermediate space, to be evacuated without any problem. An undesired mechanical-thermal contact between the aluminum foil layers is also reduced. This contact could disturb the temperature gradient, established by radiation exchange, of the aluminum foil layers.

According to a further embodiment, the thermal shield has two cover portions, which close off the base portion at both end faces.

The cover portions are preferably curved. In particular, the cover portions are each outwardly curved with respect to the base portion.

According to a further embodiment, the thermal shield is not supported on either the inner container or the outer container.

The fact that the thermal shield is not supported on either the inner container or the outer container means that better thermal insulation can be achieved. In particular, it is possible in this way for the heat input into the inner container by heat conduction to be reduced. Preferably, the thermal shield comprises a carrying ring, which is suspended from the outer container via support rods, in particular tension rods. Likewise, the inner container is preferably suspended from the carrying ring via further support rods, in particular likewise tension rods.

According to a further embodiment, the thermal shield is fluid-permeable.

That is to say, the thermal shield is liquid- and gas-permeable. For this purpose, the thermal shield may have for example apertures, perforations or bores. In this way, the intermediate space provided between the inner container and the outer container can be evacuated.

According to a further embodiment, the thermal shield is produced from an aluminum material.

In particular, the thermal shield is produced from a high-purity aluminum material. This results in particularly good heat-transport and heat-reflection properties.

According to a further embodiment, the thermal shield has at least one cooling line for actively cooling it, in which line the cryogenic liquid is receivable.

Preferably, the cryogenic liquid does not circulate in the cooling line, but resides therein. For cooling the thermal shield, the cryogenic liquid boils in the cooling line, as a result of which optimum cooling of the thermal shield is ensured. The cooling line may be connected to the thermal shield in an integrally bonded manner or be formed with the thermal shield in a materially integral manner.

According to a further embodiment, the coolant container is in fluid connection with the at least one cooling line such that the cryogenic liquid flows into the at least one cooling line from the coolant container if the cryogenic liquid in the at least one cooling line partially evaporates. In order that the cryogenic liquid completely wets the cooling line even with a reduced fill level of the cryogenic liquid in the coolant container, according to the hydrostatic pressure to be applied, a corresponding positive pressure of 200 to 300 mbar is maintained in the coolant container.

In particular, gas bubbles form in the cryogenic liquid and, due to a sloping arrangement of the cooling line, are able to be conducted to the highest point of said line.

According to a further embodiment, the at least one cooling line is provided on the base portion and/or on the cover portion of the thermal shield, and/or the base portion is connected to the cover portion in an integrally bonded manner.

In particular, such cooling lines, or at least portions of the cooling lines, are provided on both cover portions. The fact that the cover portion is connected to the base portion in an integrally bonded manner means that the cooling of the cover portion can be realized by heat conduction. In the case of integrally bonded connections, the parts being connected are held together by atomic or molecular forces. Integrally bonded connections are non-releasable connections, which can only be separated by destroying the connecting means.

According to a further embodiment, the at least one cooling line has a gradient with respect to a horizontal.

That is to say, the cooling line is inclined with respect to the horizontal. The horizontal is arranged perpendicular to a direction of gravitational force. For example, the cooling line includes, and in particular sloping portions of the cooling line include, a predetermined angle with the horizontal. In particular, the portions include an angle of greater than 3° with the horizontal. The angle may be 3 to 15° or even more. In particular, the angle may also be exactly 3°. The cooling line may also have portions which extend in the direction of gravitational force.

According to a further embodiment, the transport container also comprises a phase separator for separating a gaseous phase of the cryogenic liquid from a liquid phase of the cryogenic liquid, wherein the at least one cooling line is arranged such that it has a positive gradient in the direction of the phase separator.

A positive gradient is to be understood as meaning that the cooling line rises in the direction of the phase separator. Consequently, the gaseous phase, in the form of gas bubbles, accumulates in the phase separator. The phase separator preferably comprises a float with a float body, which is coupled to a valve body. As soon as the liquid level of the liquid phase in the phase separator falls due to the gas bubbles being introduced, the valve body is lifted off from a valve seat and the gaseous phase of the cryogenic liquid is blown off. As a result, the liquid phase flows into the phase separator, whereby the float body floats up again and the valve body is pressed onto the valve seat. In particular, the phase separator ensures that only evaporated, cryogenic nitrogen is delivered to the surroundings.

According to a further embodiment, the transport container also comprises a multiplicity of, in particular six, cooling lines.

There may be any number of cooling lines.

According to a further embodiment, the cover portion of the thermal shield shields the coolant container completely from the inner container.

This is to be understood as meaning that, when looking from the inner container in the direction of the coolant container, the coolant container is completely covered by the cover portion of the thermal shield.

According to a further embodiment, the coolant container is arranged next to the inner container in an axial direction of the inner container.

Preferably, an intermediate space, in which the cover portion of the thermal shield is arranged, is provided between the inner container and the coolant container.

According to a further embodiment, the thermal shield completely encloses the inner container.

This ensures that the inner container is completely surrounded by surfaces which are at a temperature corresponding to the boiling temperature of the cryogenic liquid.

Further possible implementations of the transport container also comprise combinations not explicitly specified of features or embodiments described above or below with regard to the exemplary embodiments. A person skilled in the art will also add individual aspects as improvements or supplementations to the respective basic form of the transport container.

BRIEF DESCRIPTION OF THE DRAWINGS

Further advantageous configurations of the transport container form the subject matter of the dependent claims and of the exemplary embodiments of the transport container described below. The transport container will be explained in detail hereinafter on the basis of preferred embodiments with reference to the appended figures, in which:

In the figures, elements that are identical or have the same function have been provided with the same reference signs, unless stated otherwise.

Figure 1:
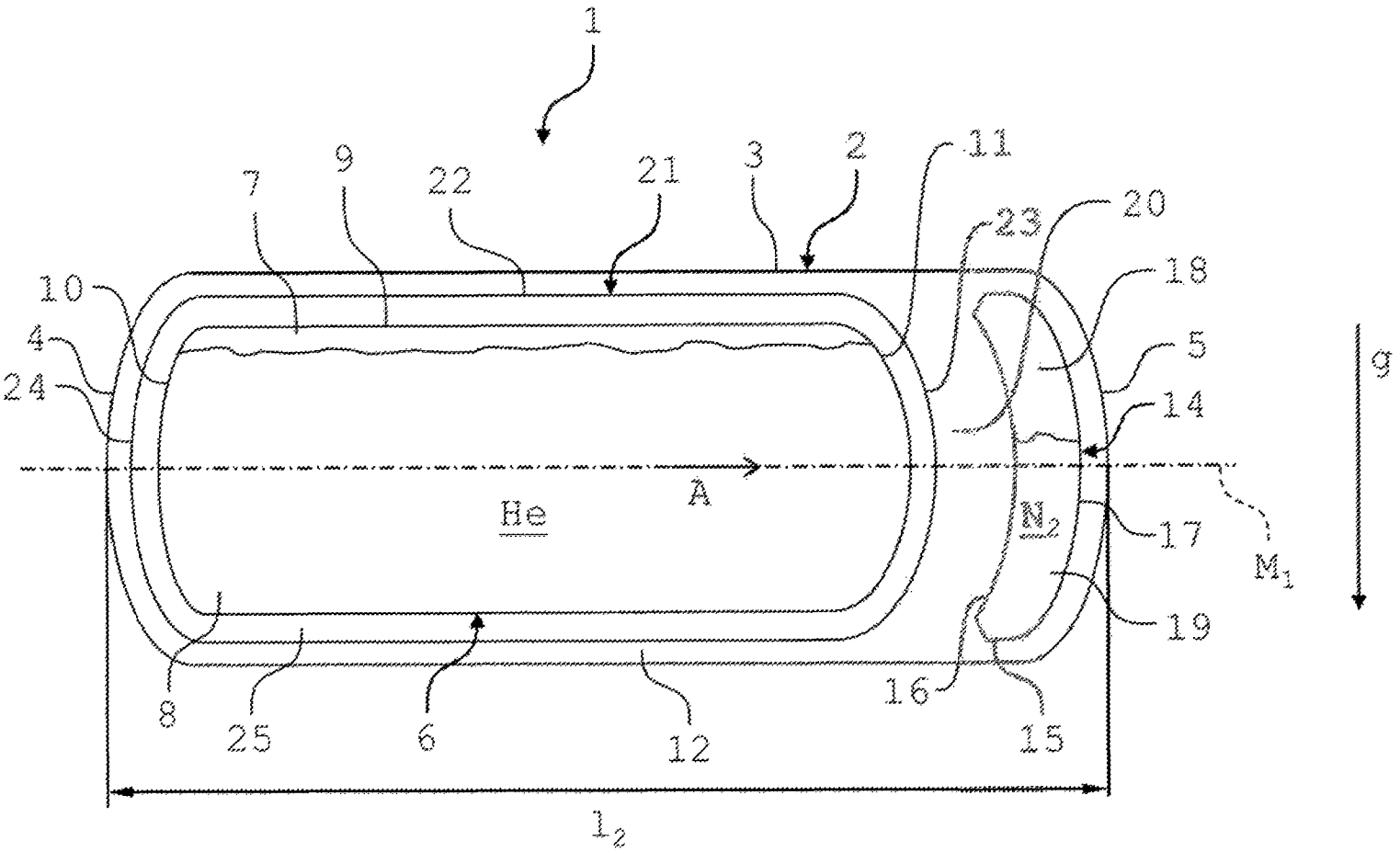
FIG. 1 shows a schematic sectional view of one embodiment of a transport container.
Figure 2:
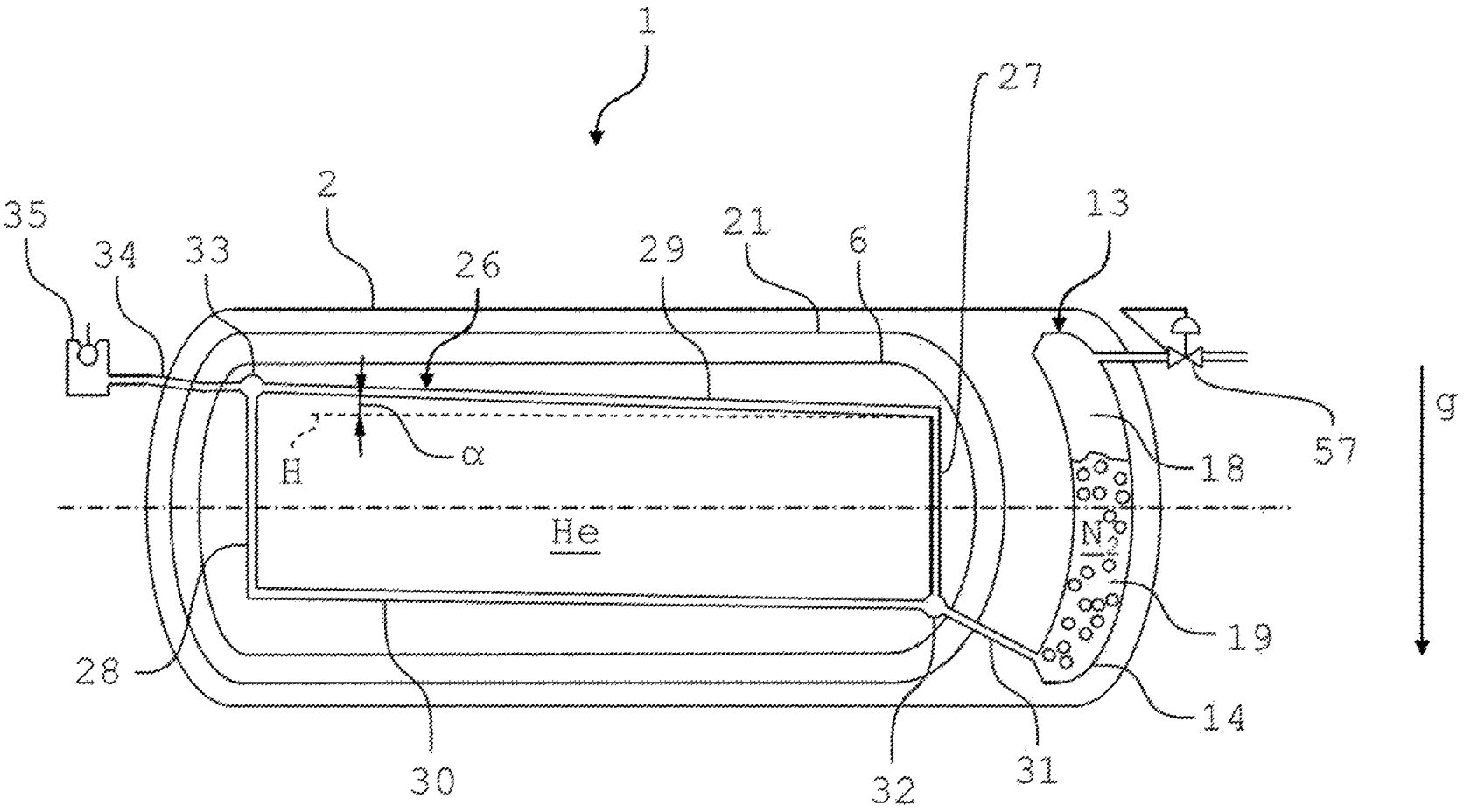
FIG. 2 shows a further schematic sectional view of the transport container as per FIG. 1.
Figure 3:
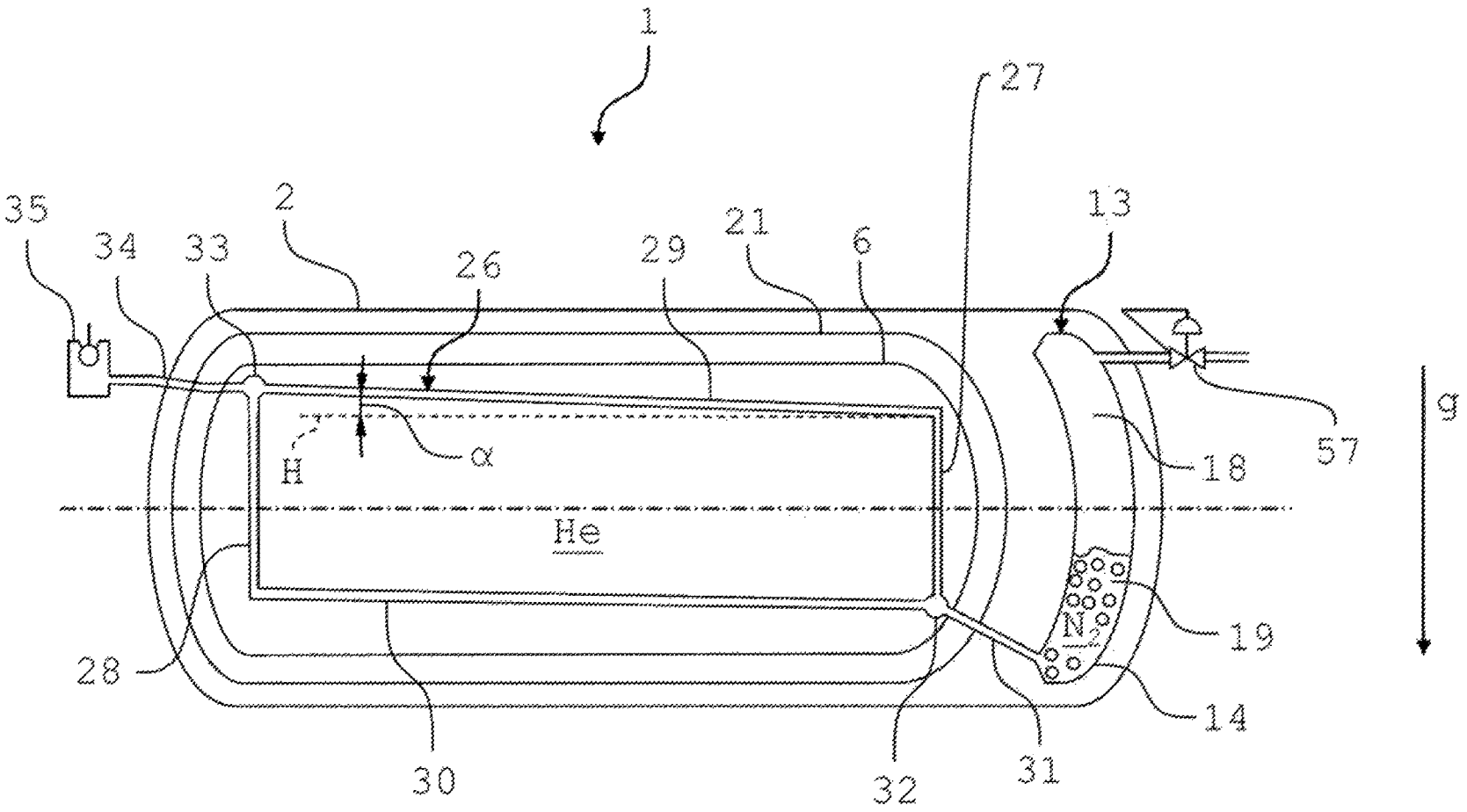
FIG. 3 shows a further schematic sectional view of the transport container as per FIG. 1.
Figure 4:
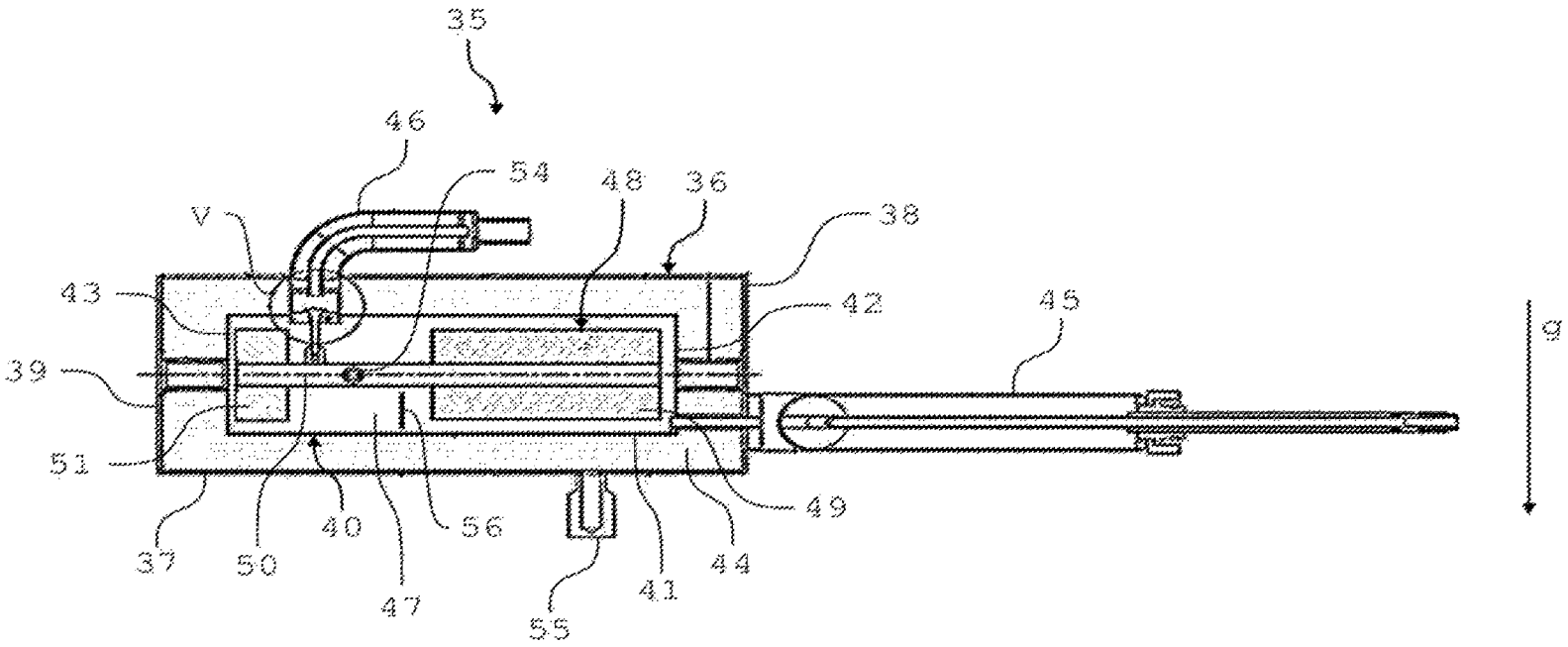
FIG. 4 shows a schematic sectional view of one embodiment of a phase separator for the transport container as per FIG. 1.
Figure 5:
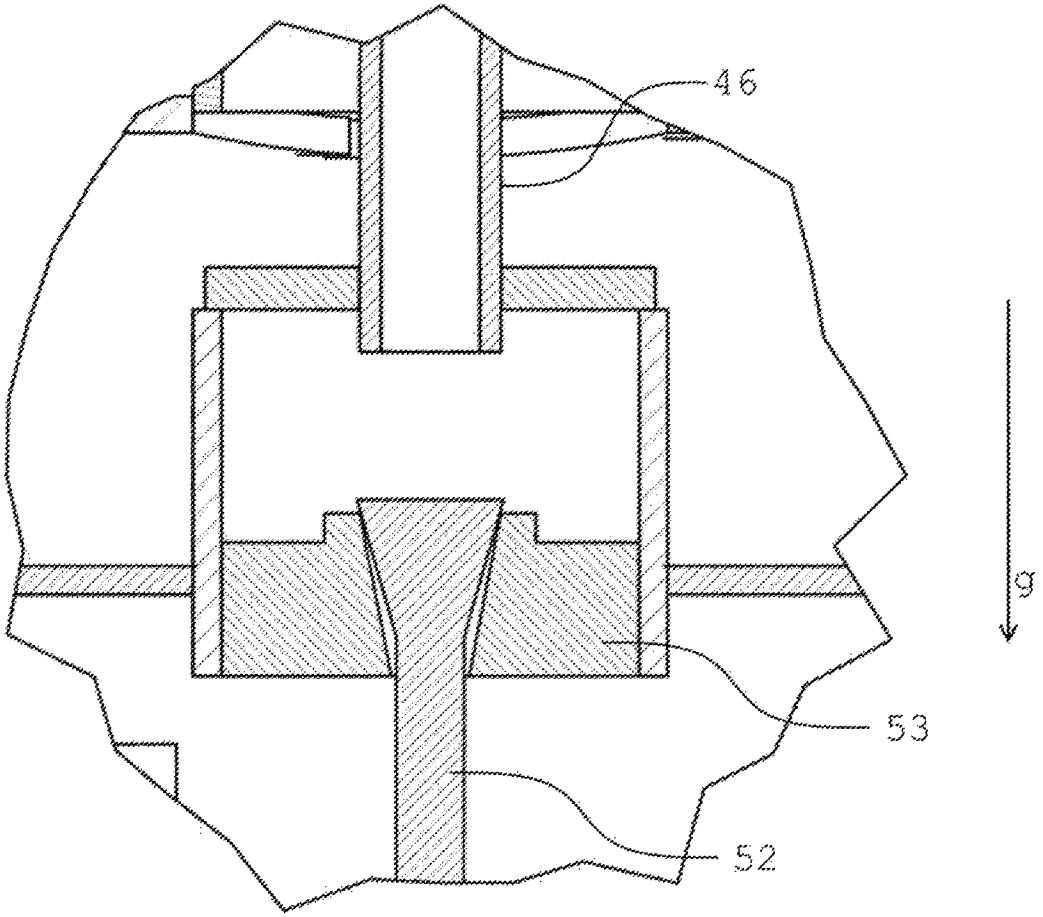
FIG. 5 shows the detail view V as per FIG. 4.
Figure 6:
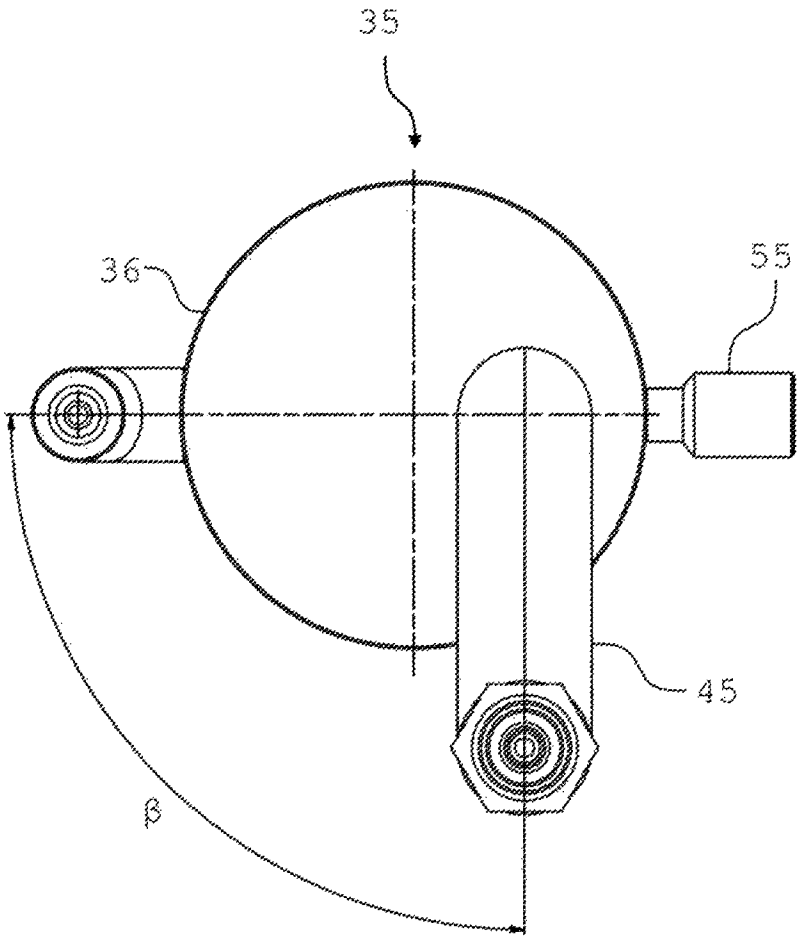
FIG. 6 shows a schematic rear view of the phase separator as per FIG. 4.
Figure 7:
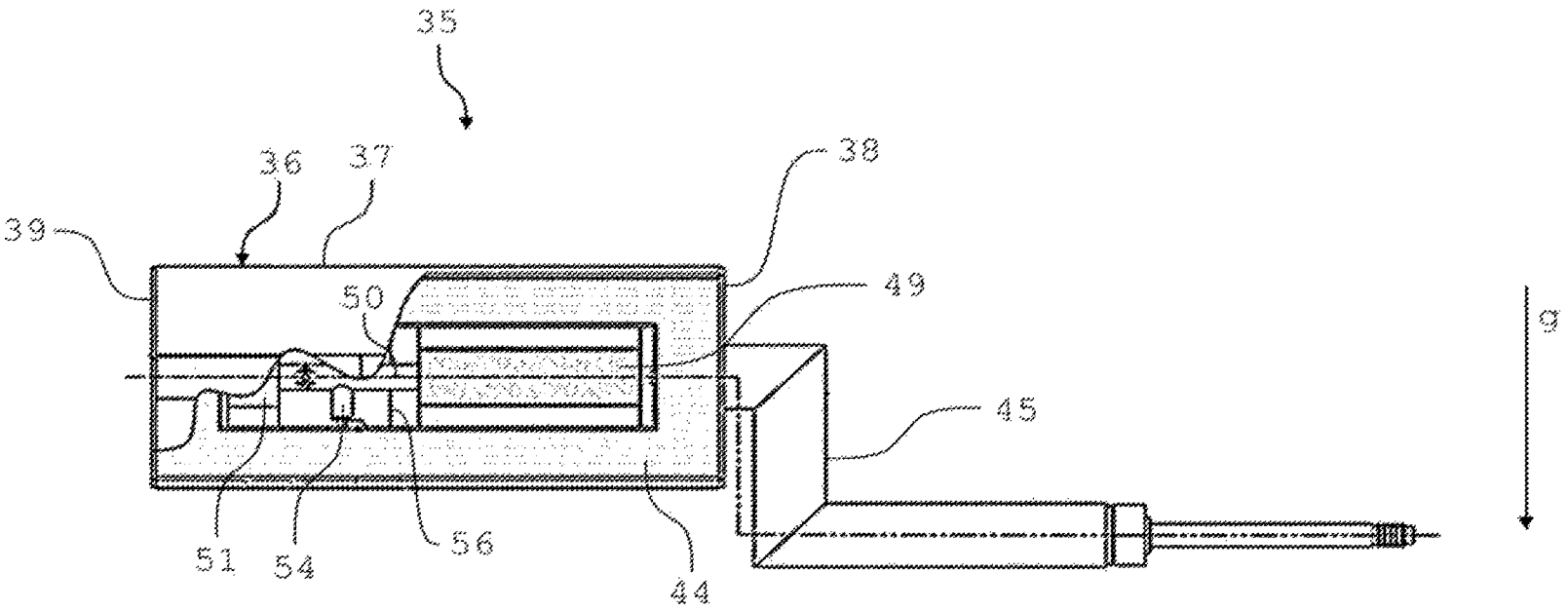
FIG. 7 shows a schematic partially sectional view of the phase separator as per FIG. 4.

FIG. 1 shows a highly simplified schematic sectional view of one embodiment of a transport container 1 for liquid helium He. FIGS. 2 and 3 show further schematic sectional views of the transport container 1. In the following text, reference is made to FIGS. 1 to 3 simultaneously.

The transport container 1 may also be referred to as a helium transport container. The transport container 1 may also be used for other cryogenic liquids. Examples of cryogenic liquids, or cryogens for short, are the previously mentioned liquid helium He (boiling point at 1 bara: 4.222 K=−268.928° C.), liquid hydrogen $H_2$ (boiling point at 1 bara: 20.268 K=−252.882° C.), liquid nitrogen $N_2$ (boiling point at 1 bara: 77.35 K=−195.80° C.) or liquid oxygen $O_2$ (boiling point at 1 bara: 90.18 K=−182.97° C.).

The transport container 1 comprises an outer container 2. The outer container 2 is produced for example from high-grade steel. The outer container 2 may have a length $l_2$ of for example 10 meters. The outer container 2 comprises a tubular or cylindrical base portion 3, which is closed at each of both the end faces with the aid of a cover portion 4, 5, in particular with the aid of a first cover portion 4 and a second cover portion 5. The base portion 3 may have a circular or approximately circular geometry in cross section. The cover portions 4, 5 are curved. The cover portions 4, 5 are curved in opposite directions such that both cover portions 4, 5 are outwardly curved with respect to the base portion 3. The outer container 2 is fluid-tight, in particular gas-tight. The outer container 2 has an axis of symmetry or center axis $M_1$, in relation to which the outer container 2 is constructed rotationally symmetrically.

The transport container 1 also comprises an inner container 6 for receiving the liquid helium He. The inner container 6 is likewise produced for example from high-grade steel. As long as the helium He is in the two-phase region, a gas zone 7 with evaporated helium He and a liquid zone 8 with liquid helium He may be provided in the inner container 6. The inner container 6 is fluid-tight, in particular gas-tight, and may comprise a blow-off valve for controlled pressure reduction. Like the outer container 2, the inner container 6 comprises a tubular or cylindrical base portion 9, which is closed at both end faces by cover portions 10, 11, in particular a first cover portion 10 and a second cover portion 11. The base portion 9 may have a circular or approximately circular geometry in cross section.

Like the outer container 2, the inner container 6 is formed rotationally symmetrically in relation to the center axis $M_1$. An intermediate space 12 provided between the inner container 6 and the outer container 2 is evacuated. The inner container 6 may also have an insulating element (not shown in FIGS. 1 to 3). The insulating element has, on the outside, a highly reflective copper layer, for example a copper foil or an aluminum foil with a vapor-deposited copper coating, and a multilayered insulating layer arranged between the inner container 6 and the copper layer. The insulating layer comprises multiple alternately arranged layers of perforated and embossed aluminum foil, as a reflector, and glass paper, as a spacer, between the aluminum foils. The insulating layer may comprise 10 layers. The layers of aluminum foil and glass paper are applied on the inner container 6 without any gaps, that is to say are pressed. The insulating layer is a so-called MLI. The inner container 6 and also the insulating element are, on the outside, approximately at a temperature corresponding to the boiling point of the helium He.

The transport container 1 also comprises a cooling system 13 (FIGS. 2, 3) with a coolant container 14. A cryogenic liquid, such as for example liquid nitrogen $N_2$, is accommodated in the coolant container 14. The coolant container 14 comprises a tubular or cylindrical base portion 15, which may be constructed rotationally symmetrically in relation to the center axis $M_1$. The base portion 15 may have a circular or approximately circular geometry in cross section. The base portion 15 is closed at each of the end faces by a cover portion 16, 17. The cover portions 16, 17 may be curved. In particular, the cover portions 16, 17 are curved in the same direction. The coolant container 14 may also have a different construction.

A gas zone 18 with evaporated nitrogen $N_2$ and a liquid zone 19 with liquid nitrogen $N_2$ may be provided in the coolant container 14. The coolant container 14 is arranged next to the inner container 6 in an axial direction A of the inner container 6. An intermediate space 20, which may be part of the intermediate space 12, is provided between the inner container 6, in particular the cover portion 11 of the inner container 6, and the coolant container 14, in particular the cover portion 16 of the coolant container 14. That is to say, the intermediate space 20 is likewise evacuated.

The transport container 1 also comprises a thermal shield 21 assigned to the cooling system 13. The thermal shield 21 is arranged in the evacuated intermediate space 12 provided between the inner container 6 and the outer container 2. The thermal shield 21 is actively coolable or actively cooled with the aid of the liquid nitrogen $N_2$. "Active cooling" is to be understood in the present case as meaning that, for cooling the thermal shield 21, the liquid nitrogen $N_2$ is passed through, or passed along, said shield. Here, the thermal shield 21 is cooled to a temperature which corresponds approximately to the boiling point of the nitrogen $N_2$.

The thermal shield 21 comprises a cylindrical or tubular base portion 22, which is closed on both sides by a cover portion 23, 24 closing it off at the end face. Both the base portion 22 and the cover portions 23, 24 are actively cooled with the aid of the nitrogen $N_2$. The base portion 22 may have a circular or approximately circular geometry in cross section. The thermal shield 21 is preferably likewise constructed rotationally symmetrically in relation to the center axis $M_1$. A first cover portion 23 of the thermal shield 21 is arranged between the inner container 6, in particular the cover portion 11 of the inner container 6, and the coolant container 14, in particular the cover portion 16 of the coolant container 14. A second cover portion 24 of the thermal shield 21 faces away from the coolant container 14. The thermal shield 21 is in this case self-supporting. That is to say that the thermal shield 21 is not supported on either the inner container 6 or the outer container 2. For this purpose, the thermal shield 21 may be provided with a carrying ring, which is suspended from the outer container 2 via support rods, in particular tension rods. Also, the inner container 6 may be suspended from the carrying ring via further support rods, in particular tension rods. The heat input through the mechanical support rods is partially realized by the carrying ring. The carrying ring has pockets, which allow the support rods to be of the greatest possible thermal length. The coolant container 14 has bushings for the mechanical support rods.

A further multilayered insulating layer, in particular an MLI, may be arranged between the thermal shield 21 and the outer container 2, which insulating layer completely fills the intermediate space 12 and thus makes contact with the outside of the thermal shield 21 and the inside of the outer container 2. In contrast to the above-described insulating element of the inner container 6, in this case, layers of aluminum foil and glass paper, glass silk or glass mesh fabric of the insulating layer are introduced loosely into the intermediate space 12. "Loosely" means here that the layers of aluminum foil and of glass paper, glass silk or glass mesh fabric are not pressed, with the result that the embossing and perforation of the aluminum foil allows the insulating layer, and consequently the intermediate space 12, to be evacuated without any problem. Since, as a result, the thermal-mechanical contact between the reflector layers is minimized, the temperature gradient of the reflector layers is established more or less according to pure radiation exchange, whereby the heat transport is minimized.

The thermal shield 21 is fluid-permeable. That is to say that an intermediate space 25 between the inner container 6 and the thermal shield 21 is in fluid connection with the intermediate space 12. As a result, the intermediate spaces 12, 25 can be evacuated simultaneously. Bores, apertures or the like may be provided in the thermal shield 21, in order to allow evacuation of the intermediate spaces 12, 25. The thermal shield 21 is preferably produced from a high-purity aluminum material. The thermal shield 21 is arranged peripherally spaced apart from the copper layer of the insulating element of the inner container 6 and does not make contact with it. As a result, the heat input is mainly realized by radiation and is consequently reduced to the minimum physically possible. A gap width of a gap provided between the copper layer and the thermal shield 21 may be 10 mm. Consequently, heat can be transferred from the inner container 6 to the thermal shield 21 only by radiation and residual gas conduction.

The first cover portion 23 of the thermal shield 21 shields the cooling container 14 completely from the inner container 6. That is to say, when looking in the direction from the inner container 6 toward the coolant container 14, the coolant container 14 is completely covered by the first cover portion 23 of the thermal shield 21. In particular, the thermal shield 21 completely encloses the inner container 6. That is to say, the inner container 6 is arranged completely inside the thermal shield 21, wherein, as already mentioned above, the thermal shield 21 is not fluid-tight.

As is also shown in FIGS. 2 and 3, the thermal shield 21 comprises at least one cooling line 26 for actively cooling it. Preferably, multiple such cooling lines 26 are provided, for example six such cooling lines 26. The cooling line 26 may comprise two vertical portions 27, 28, extending in a direction of gravitational force g, and two sloping portions 29, 30. The vertical portions 27, 28 may be provided on the cover portions 23, 24 of the thermal shield 21.

The cooling line 26 is in fluid connection with the coolant container 14 via a connection line 31 such that the liquid nitrogen $N_2$ is forced from the coolant container 14 into the cooling line 26. The connection line 31 opens out into a distributor 32, from which the portion 27 and the portion 30 branch off. The portion 29 and the portion 28 meet at a manifold 33, from which a connection line 34 leads to a phase separator 35 arranged outside the outer container 2. The phase separator 35 is set up to separate gaseous nitrogen $N_2$ from liquid nitrogen $N_2$. It is possible via the phase separator 35 for the gaseous nitrogen $N_2$ to be blown off from the cooling system 13.

The cooling line 26 or the cooling lines 26 is/are provided both on the base portion 22 and on the cover portions 23, 24 of the thermal shield 21. Alternatively, the cover portions 23, 24 are connected to the base portion 22 in a materially bonded manner. For example, the cover portions 23, 24 are welded to the base portion 22. If the cover portions 23, 24 are connected to the base portion 22 in a materially bonded manner, that is to say in an integrally bonded manner, the cooling of the cover portions 23, 24 can be realized by heat conduction. The cooling line 26, and in particular the sloping portions 29, 30 of the cooling line 26, has/have a gradient with respect to a horizontal H, which is arranged perpendicular to the direction of gravitational force g. In particular, the portions 29, 30 include an angle $\alpha$ of greater than 3° with the horizontal H. The angle $\alpha$ may be 3 to 15° or even more.

In particular, the angle α may also be exactly 3°. In particular, the portions 29, 30 have a positive gradient in the direction of the phase separator 35.

One embodiment of the phase separator 35 is shown in FIGS. 4 to 7. The phase separator 35 comprises a housing 36 with a tubular base portion 37, which is closed at the end face at each of the two end faces by cover portions 38, 39. Accommodated in the housing 36 is an inner housing 40 with a tubular base portion 41, which is closed at each of the two end faces by cover portions 42, 43. An evacuated insulating space 44 is provided between the housing 36 and the inner housing 40. The insulating space 44 may, for example, be provided with an MLI or be filled with perlite or glass microbeads. A connection line 45, which is partially likewise vacuum-insulated, is in fluid connection with the connection line 34. The phase separator 35 also comprises a blow-off line 46, via which gaseous nitrogen $N_2$ is discharged. The connection line 45 is in fluid connection with an interior space 47 provided in the inner housing 40. The connection line 45 is rotationally offset with respect to the blow-off line 46 by an angle β. The angle β may be 45 to 90°.

A float 48 is provided in the interior space 47. The float 48 comprises a float body 49, which is provided with a gas-tight metallic casing and has its interior filled by a plastic foam. The float body 49 is connected fixedly to a counterweight 51 via a shaft 50. A valve body 52 which is arranged in a linearly displaceable manner in a valve seat 53 is fastened to the shaft 50. The shaft 50 is mounted rotatably in the inner housing 40 at an axis of rotation 54. That is to say, when the liquid level of the liquid nitrogen $N_2$ in the interior space 47 falls, the float body 49 falls, whereby the shaft 50 rotates about the axis of rotation 54, whereby in turn the valve body 52 is lifted off from the valve seat 53 in order to blow off the gaseous nitrogen $N_2$ via the blow-off line 46. The phase separator 35 ensures that only evaporated, cryogenic nitrogen $N_2$ is delivered to the surroundings. The phase separator 35 is in particular a cryogenic valve regulated by the float 48. The special feature of the phase separator 35 is the counterweight 51 of the horizontally mounted float body 49, which counterweight prevents the valve body 52 from being lifted off from the valve seat 53 unintentionally in the event of accelerations.

The phase separator 35 also comprises a valve 55 for generating a vacuum in the insulating space 44. An impact sheet 56, which is intended to reduce sloshing movement of the liquid nitrogen $N_2$, may be arranged in the inner housing 40.

Also, as is shown in FIGS. 2 and 3, a blow-off valve 57 is arranged at the coolant container 14 in order to maintain the set positive pressure in the coolant container 14 by blowing off the gaseous nitrogen $N_2$.

The functioning of the transport container 1 will be explained below. Before the filling of the inner container 6 with the liquid helium He, firstly the thermal shield 21 is cooled down with the aid of cryogenic, initially gaseous and later liquid, nitrogen $N_2$ at least approximately or right up to the boiling point (at 1.3 bara: 79.5 K) of the liquid nitrogen $N_2$. The inner container 6 is in this case not yet actively cooled. During the cooling down of the thermal shield 21, the residual vacuum gas still situated in the intermediate space 12 is frozen out on the thermal shield 21. In this way, when filling the inner container 6 with the liquid helium He, it can be prevented that the residual vacuum gas is frozen out on the outside of the inner container 6 and thereby contaminates the metallically bright surface of the copper layer of the insulating element of the inner container 6. As soon as the thermal shield 21 and the coolant container 14 have cooled down completely and the coolant container 14 is again completely filled with nitrogen $N_2$, the inner container 6 is filled with the liquid helium He.

The transport container 1 may then be transferred onto a transporting vehicle, such as for example a truck or a ship, for the purpose of transporting the helium He. This involves cooling the thermal shield 21 continuously with the aid of the liquid nitrogen $N_2$. The liquid nitrogen $N_2$ is thus used and boils in the cooling lines 26. Gas bubbles produced in the process are fed through the phase separator 35, which is arranged highest in the cooling system 13 with respect to the direction of gravitational force g. As a result, the liquid level in the interior space 47 of the phase separator 35 falls, whereby the float body 49 also falls and the shaft 50 rotates about the axis of rotation 54, whereby the valve body 52 is lifted off from the valve seat 53. In this way, the gaseous nitrogen $N_2$ is blown off via the blow-off line 46. As soon as the gaseous nitrogen $N_2$ has been removed from the cooling system 13, liquid nitrogen $N_2$ flows into the phase separator 35, whereby the float body 49 floats up again and the valve body 52 is pressed onto the valve seat 53. Here, the opening and closing of the phase separator 35 is realized in the Hertz range.

Due to the mass inertia of the counterweight 51, unintended acceleration of the float body 49 during transport, for example due to vibrations, as a result of which the valve body 52 could lift off from the valve seat 53, can be prevented. Consequently, undesired loss of nitrogen $N_2$ can be prevented. The fact that the thermal shield 21 is also arranged between the coolant container 14 and the inner container 6 means that it can be reliably ensured that the inner container 6 is sufficiently cooled even when there is a falling filling level or liquid level of nitrogen $N_2$ in the coolant container 14. The fact that the inner container 6 is completely surrounded by the thermal shield 21 means that it is ensured that the inner container 6 is surrounded only by surfaces which are at a temperature corresponding to the boiling point (at 1.3 bara, 79.5 K) of nitrogen $N_2$. In this way, there is only a small difference in temperature between the thermal shield 21 (79.5 K) and the inner container 6 (4.2-6 K). This allows the holding time for the liquid helium He to be lengthened significantly in comparison with known transport containers. Heat is in this case transferred from the inner container 6 to the thermal shield 21 only by radiation and residual gas conduction. The transport container 1 has in particular a holding time for helium of at least 45 days, and the supply of liquid nitrogen $N_2$ is sufficient for at least 40 days.

Although the present invention has been described using exemplary embodiments, it is modifiable in various ways.

REFERENCE SIGNS USED

1 Transport container
2 Outer container
3 Base portion
4 Cover portion
5 Cover portion
6 Inner container
7 Gas zone
8 Liquid zone
9 Base portion
10 Cover portion
11 Cover portion
12 Intermediate space
13 Cooling system
14 Coolant container

15 Base portion
16 Cover portion
17 Cover portion
18 Gas zone
19 Liquid zone
20 Intermediate space
21 Shield
22 Base portion
23 Cover portion
24 Cover portion
25 Intermediate space
26 Cooling line
27 Portion
28 Portion
29 Portion
30 Portion
31 Connection line
32 Distributor
33 Manifold
34 Connection conductor
35 Phase separator
36 Housing
37 Base portion
38 Cover portion
39 Cover portion
40 Inner housing
41 Base portion
42 Cover portion
43 Cover portion
44 Insulating space
45 Connection line
46 Blow-off line
47 Interior space
48 Float
49 Float body
50 Shaft
51 Counterweight
52 Valve body
53 Valve seat
54 Axis of rotation
55 Valve
56 Impact sheet
57 Blow-off valve
A Axial direction
g Direction of gravitational force
H Horizontal
He Helium
$H_2$ Hydrogen
$l_2$ Length
$M_1$ Center axis
$N_2$ Nitrogen
$O_2$ Oxygen
α Angle
β Angle

The invention claimed is:

1. A transport container for helium comprising:

an inner container for receiving the helium, a coolant container for receiving a cryogenic liquid, an outer container in which the inner container and the coolant container are accommodated, and a thermal shield which is actively coolable with aid of the cryogenic liquid, wherein the thermal shield has a tubular base portion in which the inner container is accommodated, and a cover portion which closes off the base portion at an end face and which is arranged between the inner container and the coolant container, wherein an intermediate space, in which the cover portion of the thermal shield is arranged, is provided between the inner container and the coolant container, wherein the thermal shield has at least one cooling line for actively cooling the thermal shield, in which line the cryogenic liquid is receivable, and at least a portion of the at least one cooling line has a gradient with respect to a horizontal, and said container further comprises a phase separator for separating a gaseous phase of the cryogenic liquid from a liquid phase of the cryogenic liquid, wherein the at least one cooling line is arranged such that said at least one portion of the at least one cooling line has a positive gradient in the direction of the phase separator.

2. The transport container as claimed in claim 1, wherein the thermal shield is arranged in an evacuated intermediate space provided between the inner container and the outer container.

3. The transport container as claimed in claim 1, wherein the thermal shield has two cover portions, which close off the base portion at both end faces.

4. The transport container as claimed in claim 1, wherein the thermal shield is not supported on either the inner container or the outer container.

5. The transport container as claimed in claim 1, wherein the thermal shield is fluid-permeable.

6. The transport container as claimed in claim 1, wherein the thermal shield is produced from an aluminum material.

7. The transport container as claimed in claim 1, wherein the coolant container is in fluid connection with the at least one cooling line such that the cryogenic liquid flows into the at least one cooling line from the coolant container if the cryogenic liquid in the at least one cooling line partially evaporates.

8. The transport container as claimed in claim 1, wherein the at least one cooling line is provided on the base portion and/or on the cover portion of the thermal shield.

9. The transport container as claimed in claim 1, wherein said container has comprising a multiplicity of cooling lines.

10. The transport container as claimed in claim 1, wherein the cover portion of the thermal shield shields the coolant container completely from the inner container.

11. The transport container as claimed in claim 1, wherein the coolant container is arranged next to the inner container in an axial direction of the inner container.

12. The transport container as claimed in claim 1, wherein the thermal shield completely encloses the inner container.

13. The transport container as claimed in claim 1, wherein the base portion is connected to the cover portion in an integrally bonded manner.

14. The transport container as claimed in claim 8, wherein the base portion is connected to the cover portion in an integrally bonded manner.

15. The transport container as claimed in claim 1, wherein the outer container comprises a cylindrical a base portion which is closed at each end face by a cover portion, and each cover portion of the outer container is outwardly curved with respect to the base portion thereof, and the inner container comprises a cylindrical a base portion which is closed at each end face by a cover portion.

16. The transport container as claimed in claim 1, wherein the at least cooling line comprises two vertical portions and two portions having a gradient with respect to a horizontal.

17. The transport container as claimed in claim 1, wherein the at least cooling line is in fluid connection with the coolant container via a first connection line and is in fluid connection with the phase separator via a second connection line.

* * * * *